US007360630B2

(12) United States Patent
Brant

(10) Patent No.: US 7,360,630 B2
(45) Date of Patent: Apr. 22, 2008

(54) ELEVATOR POSITIONING SYSTEM

(75) Inventor: John S. Brant, Whittier, CA (US)

(73) Assignee: ThyssenKrupp Elevator Capital Corporation, Troy, MI (US)

( * ) Notice: Subject to any disclaimer, the term of this patent is extended or adjusted under 35 U.S.C. 154(b) by 472 days.

(21) Appl. No.: 10/709,149

(22) Filed: Apr. 16, 2004

(65) Prior Publication Data

US 2005/0230192 A1 Oct. 20, 2005

(51) Int. Cl.
*B66B 1/42* (2006.01)

(52) U.S. Cl. ..... 187/284; 187/394

(58) Field of Classification Search ..... 187/283, 187/284, 291, 394, 391
See application file for complete search history.

(56) References Cited

U.S. PATENT DOCUMENTS 2,847,091 A * 8/1958 Santini et al. ..... 187/291
3,651,893 A * 3/1972 Berkovitz ..... 187/254
3,741,348 A * 6/1973 Caputo ..... 187/284
3,749,203 A * 7/1973 Hoelscher ..... 187/291
4,094,385 A * 6/1978 Maeda et al. ..... 187/291
4,466,510 A * 8/1984 Sollog ..... 187/291
4,750,592 A 6/1988 Watt ..... 187/134
5,159,162 A * 10/1992 Tatino ..... 187/280
5,349,854 A 9/1994 Garrido et al. ..... 73/490
5,869,795 A * 2/1999 Miyazawa et al. ..... 187/291
6,283,252 B1 9/2001 Lee ..... 187/291
6,439,349 B1 8/2002 Smith ..... 187/382

* cited by examiner

*Primary Examiner*—Jonathan Salata
(74) *Attorney, Agent, or Firm*—Frost Brown Todd LLC

(57) ABSTRACT

The present invention provides an elevator position compensation system which minimizing the re-leveling of an elevator car in an elevator shaft. The elevator car is suspended in the shaft by an elevator cable system and elevator motor, wherein the elevator position compensation system includes an elevator load sensor device for determining the weight of the elevator car, and generating a load signal indicative of the determined weight. An elevator position sensor determines the position of the elevator car in the elevator shaft and generates a position signal indicative of the determined elevator car position. An elevator control system receives the load signal and the position signal, which is processed by the control system in order to calculate a change in the cable system length associated with a load change within the elevator car, and wherein the calculated change in the cable system length is compensated by the elevator motor.

28 Claims, 4 Drawing Sheets

ELEVATOR POSITIONING SYSTEM

BACKGROUND OF THE INVENTION

1. Field of Invention

The present invention concerns a method and apparatus for improving the leveling requirements of an elevator system. In particular, the invention provides a method and apparatus for reducing the required leveling by predicting the suspended load on the elevator's tension members.

2. Background of Invention

Accurate leveling between the floor of an elevator car and the landing at which the elevator is located, is an essential requirement for the safe operation of elevators. Specifications and industry standards require that elevators maintain a level difference between the elevator car floor and landing floor of within ⅜".

Elevators are generally suspended by tension members that stretch and change length. The amount by which the tension members may change in length depends on the suspended load, where the load is the weight of the elevator car, plus the weight of its contents (e.g., one or more persons). As the weight of the suspended load increases due to passengers entering the elevator car, the length of the suspension members increases as a result of stretching. Similarly, when the suspended load decreases (e.g., due to passengers leaving the elevator car), the length of the suspension members decreases.

If the magnitude of these changes in rope length cause the level difference between the elevator car floor and landing floor to exceed the ⅜" level requirement, the elevator re-levels. Re-leveling can be disconcerting to passengers and may even cause them to loose their balance. Therefore, while re-leveling is unavoidable, it should be minimized where possible. It is therefore an object of the present invention to minimize re-leveling in elevator systems.

DETAILED DESCRIPTION

Figure 1:
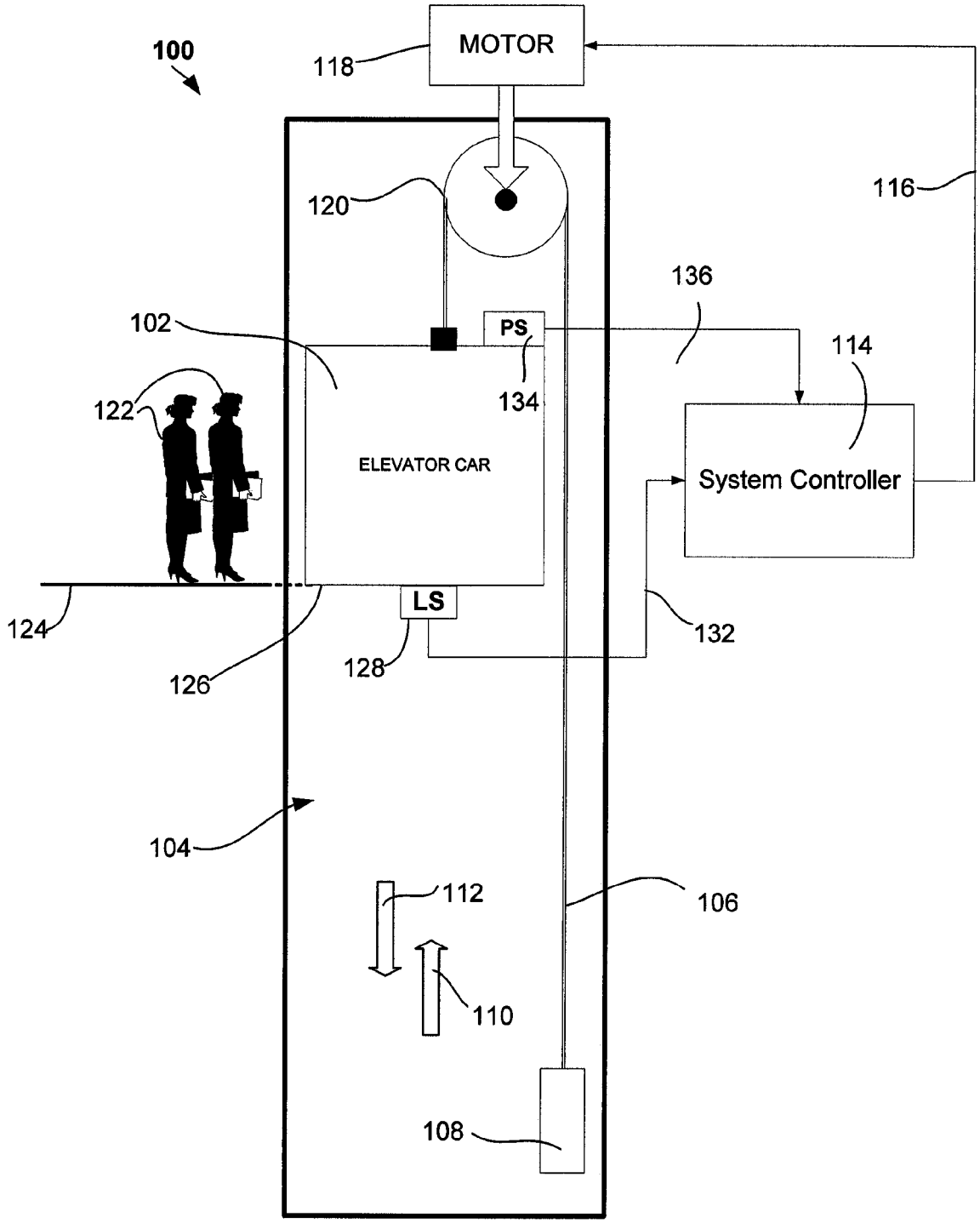
FIG. 1 illustrates an elevator system for minimizing elevator car re-leveling according to the present invention.

FIG. 1 illustrates an embodiment of an elevator system 100 according to the present invention. Elevator car 102 is suspended within elevator shaft 104 by means of tension members, such as elevator cable system 106. One end of the cable system 106 is coupled to elevator car 102, while the other end of cable system 106 is connected to a counter weight 108. The elevator moves vertically in the direction of arrows 110 and 112 under the control of elevator system controller 114. Motion control signals are generated by system controller 114 and transferred over communication link 116 to an elevator motor 118. Motor 118 receives the motion control signals and transfers rotational movement to a sheave 120, which in turn provides a corresponding movement to the cable system 106 and elevator car 102.

Passengers 122 requesting the elevator service, may initiate a hall call request. The hall call request is processed by controller 114, whereby the elevator car 102 is dispatched to the floor or landing 124 from which the call request was made. When the elevator car arrives at the designated floor or landing 124, the elevator floor level 126 should be substantially level with the landing 124. However, due to passengers entering and leaving the elevator car, various load changes are exhibited on the cable system 106, which may cause the length of the cable to change as the cable stretches under the weight of an increased load, or contracts under the weight of a reduced load. Due to the change in length of the cable system, there may be a level difference between the landing 124 and elevator floor level 126. If the level difference exceeds a predefined limit (e.g., industry standard of ⅜"), the controller 114 generates a re-leveling signal.

According to an aspect of the present invention, provided that the change in the length of the cable system 106 due to a load change in the elevator car 102 can be determined, the controller 114 can compensate for this cable length change by sending a compensation or control signal to the motor 118. Once the compensation or control signal is received by the motor 118, the cable 106 is advanced by an amount that is approximately the same as the length change. Also, the direction in which the cable system 106 is advanced is such that it counters the direction of the cable length change. For example, if the cable system 106 undergoes a length increase in the direction indicated by 112 due to a load increase, the control signal may counter this increase by moving the cable 106, and thus, the elevator car by the same amount in the opposite direction, i.e., direction 110. Conversely, if the cable system 106 undergoes a length decrease in the direction indicated by 110 due to a load decrease, the control signal may counter this decrease in cable length by moving the cable 106, and thus the elevator car, by the same amount in the opposite direction, i.e., direction 112.

Elevator car 102 includes a load sensor device 128 that measures the weight of the load imposed on the elevator car floor 130, whereby the load may constitute the weight of one or more occupants and/or various articles in the car 102. The load sensor device 128 generates a data signal associated with the weight of the load, where the data signal is sent to the system controller 114 for processing via communication link 132. Using the load sensor device 128, various weight changes resulting from different loads are detected, measured, and sent to the controller 114 for processing.

Elevator car 102 also includes position sensor 134 for indicating the position of the elevator car 102 within shaft 104. The position sensor device 134 generates a data signal associated with the position of the elevator, whereby the data signal is also sent to the system controller 114 for processing via communication link 136. Using the data from position sensor device 134, the length (L) of the cable system 106 from which the elevator car is suspended is measured and sent to the controller 114 for processing. If the elevator car 102 is dispatched to a higher floor, this length (L) decreases. Similarly, as the car 102 travels to lower level floors, the length (L) of the cable system 106 increases.

The amount or magnitude by which the cable system 106 changes in length is determined by equation (1):

$$CableSystemLengthChange = L \times \frac{\Delta W \times C}{A \times E \times N} \quad (1)$$

where L is the length of cable system 106 from which the elevator car is suspended. Therefore, "L" is the length of the portion of cable system 106 that exists between the sheave 120 and the elevator car 102. From the equation it is apparent that as length "L" increases, the "cable system length change" also increases. Length "L" is measured using data from the position sensor.

ΔW" is the measured load or weight difference (weight differential), which occurs as a result of various load changes associated with different people and/or articles occupying the elevator car 102. "ΔW" is partly calculated using the data signal generated by load sensor 128, which is also sent to the controller 114 for processing. "C" is a constant used for units of measure (e.g., conversion to mm or cm).

"A", "E", and "N" are characteristic information associated with cable system 106, where "A" is the cross sectional area, "E" is the modulus of elasticity of the cable system, and "N" is the number of ropes or cables included in the cable system 106. Cable system 106 may be any known elevator cable, whereby the cable system may be comprised of wire ropes, aramid fiber ropes, coated steel or composite belts. Depending on the elevator system design, application, and cable system type (e.g., wire ropes) used, the values of "A", "E", and "N" will vary accordingly. The characteristic information associated with the cable system may be stored in the controller 114 or downloaded from a remote secondary source.

The system controller 114 uses data associated with "A", "E", "N", "ΔW", "C", and "L" to calculate the "cable system length change." Based on the calculated "cable system length change", the system controller 114 generates a control signal for controlling the movement of the motor by a compensatory amount that is related to this length change.

Figure 2A:
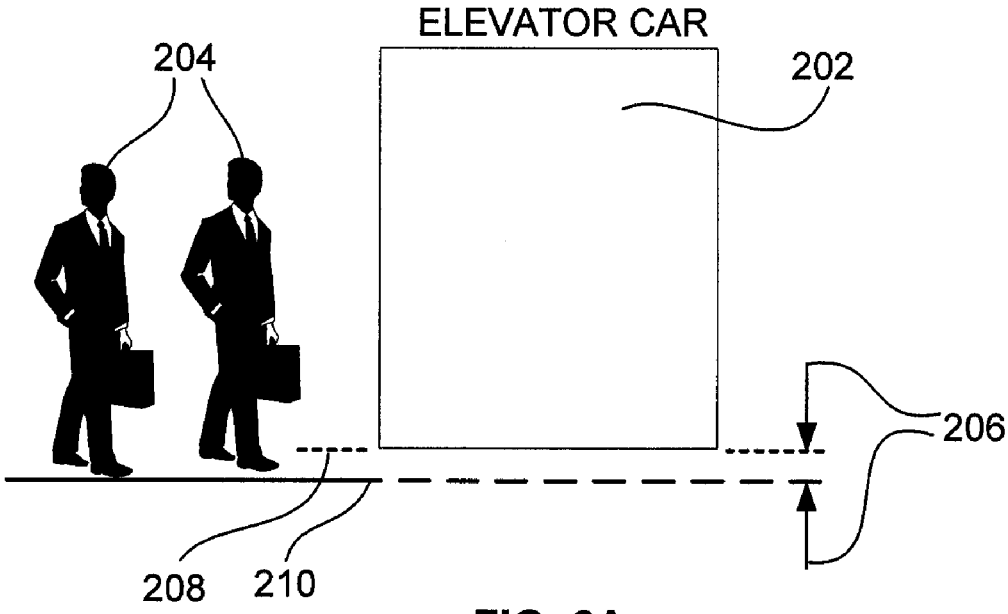
FIGS. 2A and 2B illustrate elevator car leveling compensation due to a predicted load increase within the elevator car according to the present invention.
Figure 2B:
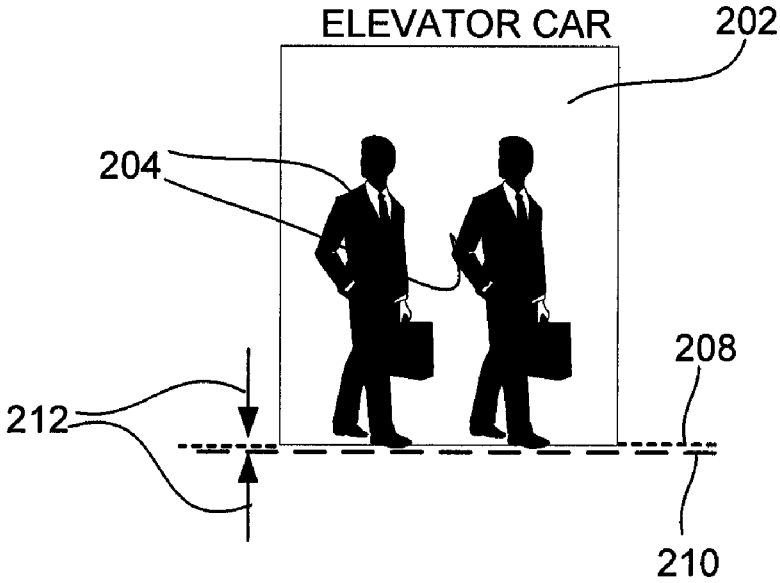

FIGS. 2A and 2B illustrate the elevator car leveling compensation that is carried out due to a predicted load increase within the elevator car according to an embodiment of an aspect of the present invention. As indicated by equation (1), once the "cable system length change" has been calculated, the magnitude and direction of the leveling compensation can be determined and executed. However, the weight differential (ΔW) must be determined in order to calculate the "cable system length change." The weight differential, which is indicative of the change in the elevator car 202 load or weight, is an inferred value that must predicted using various techniques.

For example, if a hall call request is initiated, and the elevator car 202 is dispatched to service that call, it may not know exactly how many passengers 204 and/or articles will enter the elevator car 202 and contribute to increasing its weight. In order to establish an estimate of such a value, various statistical techniques may be employed. For example, based on available stored data, it may be known that at a particular time of day, day of the week, and floor level, a particular load increase can be expected. Statistical data may be stored in the system controller 114 (FIG. 1) or at a remote storage device. Also, the statistical data may be collected periodically using the load sensor device 128 (FIG. 1), where changes in weight or load variations are detected and sent by the load sensor 128 to the processor for logging.

Knowledge of whether the car 202 is responding to a "car-call signal", a "hall-call signal", or both may also provide important data that is relevant to estimating an inferred load for car 202. For example, a "hall-call" may provide an indication that people will be getting into car 202, and therefore, a load increase may be predicted. A "car-call" on the other hand may provide an indication that people will be getting off the elevator car 202, and thus, a load decrease may be expected. Similarly, if both a "car-call" and a "hall-call" have been initiated, it may be expected that some people will be getting off the elevator car 202, while others will be getting on.

Alternatively, loading sensors and/or imaging devices may be placed on each landing in order to determine the collective weight of the passengers waiting to enter the elevator car 202. In this manner, the expected load increase may be determined.

As shown in FIG. 2A, if it is determined that passengers 204 will be entering the elevator car 202, the "cable system length change" is calculated based on the predicted or inferred weight or load increase. Once the "cable system length change" has been calculated, the motor (not shown) executes a compensatory motion, which reduces the cable system length by an amount that is approximately the same as the predicted "cable system length change". As illustrated, once the elevator car arrives at the elevator landing or floor, the elevator car floor level 208 is slightly higher than the landing floor level 210 as a result of the applied compensatory motion reducing the cable length. The difference in the elevator floor and landing floor level is defined by 206.

As shown in FIG. 2B, when passengers 204 enter the elevator car 202, the cable system length increases as a result of the increased load, which results in elevator floor level 208 becoming level with the landing floor level 210. Therefore, the compensatory reduction in the cable length (FIG. 2A) compensates for the predicted increase in the cable system length. As illustrated, the difference in the elevator floor and landing floor level approaches zero, as defined by 212. Hence, re-leveling is avoided.

Figure 3A:
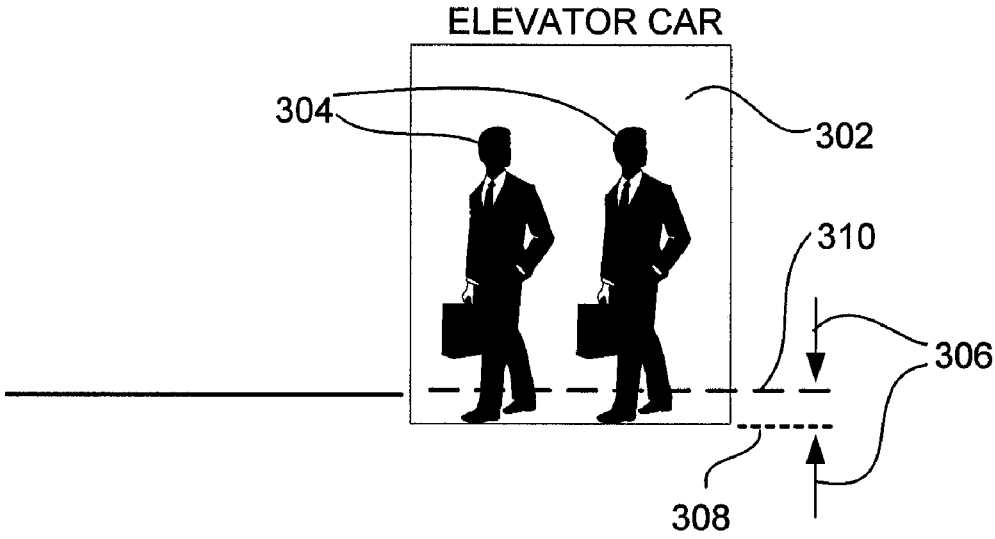
FIGS. 3A and 3B illustrate elevator car leveling compensation due to a predicted load decrease within the elevator car according to the present invention.

As shown in FIG. 3A, if it is determined that passengers 304 will be exiting the elevator car 302, the "cable system length change" is calculated based on the predicted or inferred weight or load decrease. Once the "cable system length change" has been calculated (predicted), the motor (not shown) executes a compensatory motion, which increases the cable system length by an amount that is approximately the same as the predicted "cable system length change." As illustrated, once the elevator car arrives at the elevator landing or floor, the elevator car floor level 308 is slightly lower than the landing floor level 310 as a result of the applied compensatory motion reducing the cable length. The difference in the elevator floor and landing floor level is defined by 306.

Figure 3B:
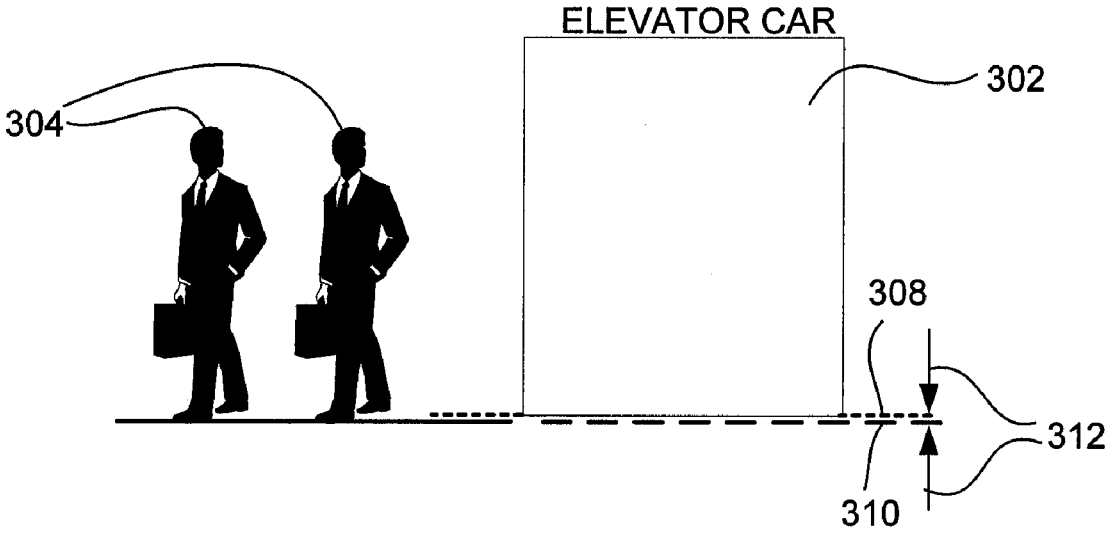

As shown in FIG. 3B, when passengers 304 exit the elevator car 302 at their designated floor, the cable system length decreases as a result of the reduced load, which results in elevator floor level 308 becoming level with the landing floor level 310. Therefore, the compensatory increase in the cable length (FIG. 3A) compensates for the predicted decrease in the cable system length, which may occur as a result of a load reduction, such as passengers 304 exiting the elevator car 302. As illustrated, the difference in the elevator floor and landing floor level approaches zero, as defined by 312. Hence, re-leveling is avoided.

Figure 4:
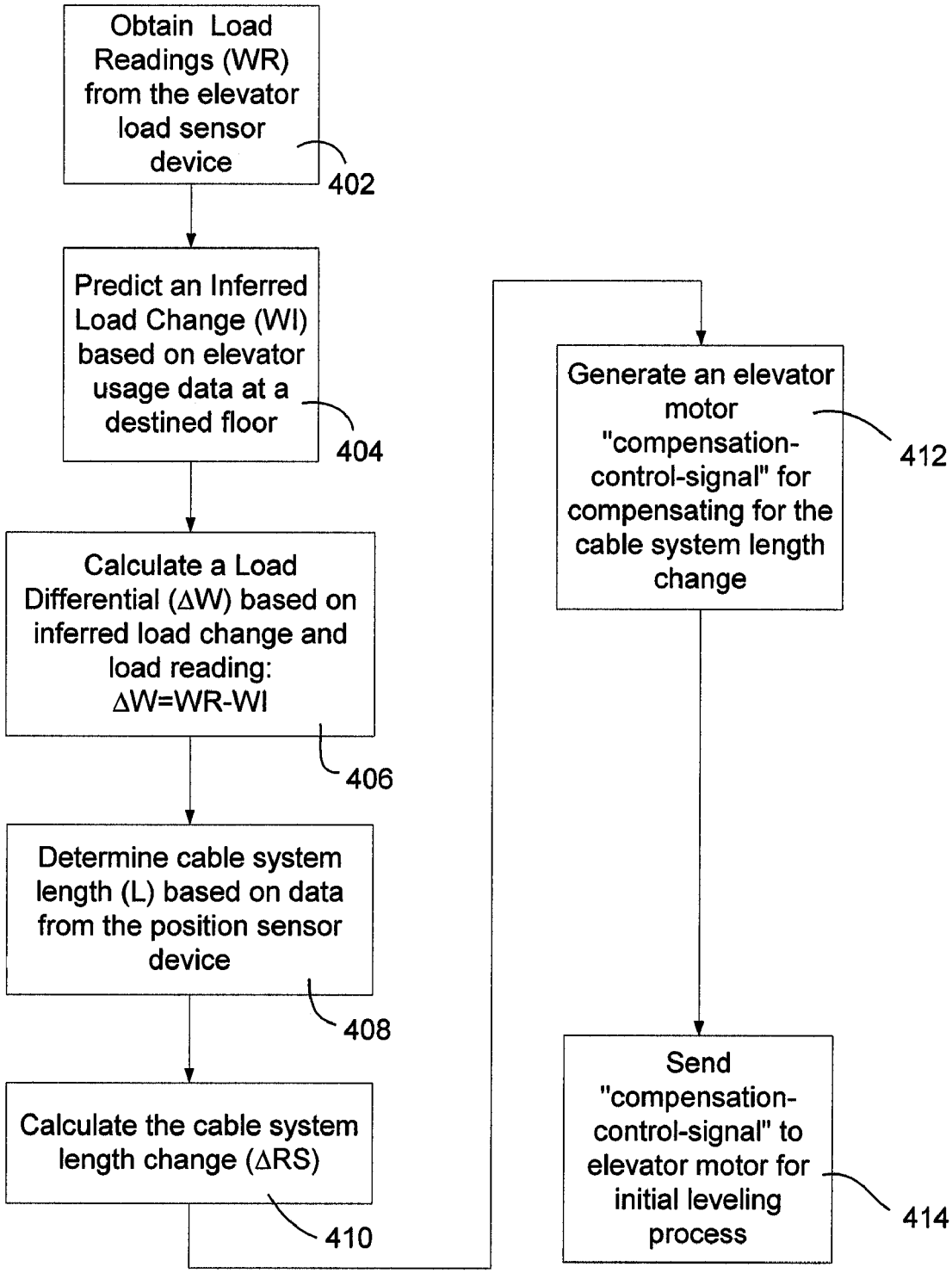
FIG. 4 illustrates a flow chart representation of the releveling minimization process according to the present invention.

FIG. 4 illustrates a flow chart representation of the releveling minimization process according to an embodiment of an aspect of the present invention. The following descriptions of FIG. 4 are based on the elevator system illustrated in FIG. 1. At step 402, a load reading (WR) is generated by the elevator load sensor device 128 (FIG. 1) and sent to the system controller 114 (FIG. 1) for processing prior to the elevator car reaching the floor or landing to which it is dispatched, following a hall call request. At step 404, as the elevator car 102 (FIG. 1) is on route to the dispatched floor or landing from which a hall call request was initiated, the controller 114 (FIG. 1) generates a predicted load or weight value (WI) at the floor or landing that the elevator car 102 (FIG. 1) is destined for. For example, as previously described, the controller may employ statistical or other techniques to infer or predict that a 120 Kg load is expected to be added to the elevator at the destined floor. In the absence of such information (e.g., statistical or other means), the system controller 114 (FIG. 1) may infer that when answering a hall call request, a given load will be added to the elevator car 102 (FIG. 1). Similarly, a car call signal initiated from within the elevator car informs the system controller 114 (FIG. 1) that car 102 (FIG. 1) will be experiencing a load reduction due to one or more passengers leaving the elevator 102 (FIG. 1) at their designated floor.

Once the predicted or inferred weight value is generated, at step 406 the load differential (ΔW) or predicted load change is generated by calculating the difference between the measured weight of the elevator car and the value of the predicted load or weight change (i.e., increase or decrease) that is expected to occur at the floor or landing to which the elevator is dispatched to.

At step 408, based on the position sensor device 134 (FIG. 1), the length of the cable system 106 (FIG. 1) between the sheave 120 (FIG. 1) and the elevator car 102 (FIG. 1) is calculated by controller 114 (FIG. 1). At step 410, controller 114 (FIG. 1) calculates (or predicts) the cable system length change based on the differential load, cable system length, and other characteristic information related to the properties of the cable system 106 (FIG. 1), in accordance with relationship indicated in Equation (1). If, at step 410, it is determined that there is going to be a negligible change in the length of the cable system length, then at step 412, the system controller 114 (FIG. 1) generates a control data signal that is approximately negligible. Thus, at step 414, the control data signal that is sent to the elevator motor 118 (FIG. 1), generates no compensatory motion.

If, however, at step 410, the calculated "cable system length change" is not negligible, then at step 412, the system controller 114 (FIG. 1) generates a control data signal for compensating for this length change, based on the calculation in step 410. At step 414, the generated control signal is sent to the elevator motor 118 (FIG. 1) in order to provide a compensatory motion that compensates for the "cable system length change" when the elevator reaches a particular floor to which it is dispatched. As illustrated in FIG. 2A, if it is determined that the "cable system length change" with be an increase, based on the calculated magnitude of this cable system length increase, the compensatory motion ensures that the elevator stops at a position, in which the elevator floor level is higher (i.e., within regulated limits) than the landing or floor level. The difference between the elevator floor level and the landing or floor level is established to be the same as the calculated "cable system length change". Similarly, as illustrated in FIG. 3A, if it is determined that the "cable system length change" with be a decrease, based on the calculated magnitude of this cable system length decrease, the compensatory motion ensures that the elevator stops at a position in which the elevator floor level is lower (i.e., within regulated limits) than the landing or floor level. The difference between the elevator floor level and the landing or floor level is established to be the same as the calculated "cable system length change".

Once the elevator arrives at the destination, and the compensatory controlling of the cable system length is executed, statistical data information regarding the accuracy of the predicted and actual "cable system length change" is processed and stored by the controller. If the differential load is calculated based on inference and predicted load changes (statistically), then based on the accuracy of this predication, the "cable system length change" calculation will include minor deviations from the actual "cable system length change". The actual "cable system length change" may be calculated once the elevator arrives at the designated floor, where the load or weight change is measured by the load sensor device 128 (FIG. 1). This enables the elevator system to build a database of updated statistical information, which allows the compensation (i.e., "cable system length change") calculations to be more accurately derived. It will also be appreciated that various prediction algorithms and techniques may be used without departing from the spirit and scope of the invention.

In addition to the embodiments of the aspects of the present invention described above, those of skill in the art will be able to arrive at a variety of other arrangements and steps which, if not explicitly described in this document, nevertheless embody the principles of the invention and fall within the scope of the appended claims. For example, the ordering of method steps is not necessarily fixed, but may be capable of being modified without departing from the scope and spirit of the present invention.

The invention claimed is:

1. An elevator position compensation system for positioning an elevator car in an elevator shaft, the elevator car suspended in the shaft by an elevator cable system and elevator motor, the elevator position compensation system comprising:

(a) an elevator load sensor device for determining the weight of the elevator car and generating a load signal indicative of the determined weight;

(b) an elevator position sensor for determining the position of the elevator car in the elevator shaft and generating a position signal indicative of the determined elevator car position; and (c) an elevator control system adapted to receive the load signal and the position signal, wherein the load signal and position signal are processed by the control system in order to calculate a change in the cable system length associated with a load change in the elevator car, and wherein the calculated change in the cable system length is compensated by the elevator motor when the elevator car is at a landing prior to an actual load change.

2. The elevator position compensation system according to claim 1, wherein the elevator control system comprises cable system data associated with the cable system characteristics, wherein the control system processes the cable system data in order to calculate the change in the cable system length.

3. The elevator position compensation system according to claim 1, wherein the elevator cable system comprises at least one aramid fiber rope.

4. The elevator position compensation system according to claim 1, wherein the elevator cable system comprises at least one wire rope.

5. The elevator position compensation system according to claim 1, wherein the elevator cable system comprises at least one coated steel belt.

6. The elevator position compensation system according to claim 1, wherein the elevator cable system comprises at least one composite belt.

7. The elevator position compensation system according to claim 2, wherein the cable system data comprises the cable system cross sectional area.

8. The elevator position compensation system according to claim 2, wherein the cable system data comprises a modulus of elasticity associated with cable system.

9. The elevator position compensation system according to claim 2, wherein the cable system data comprises an integer number associated with a number of cables within the cable system.

10. A method of positioning an elevator car in an elevator system, the elevator car suspended in a shaft by an elevator cable system, the method comprising the steps of:

(a) determining the weight differential associated with the elevator car based on load changes;

(b) determining characteristic information associated with the cable system;

(c) determining length change information associated with the cable system based on the measured weight differential and the determined characteristic information; and (d) positioning the elevator car in the shaft based on the determined length change information.

11. The method according to claim 10, wherein the weight differential is the difference between a measured weight of the elevator car and an inferred weight of the elevator car, wherein the inferred weight is predicted based on elevator activity information.

12. The method according to claim 11, wherein the elevator activity information comprises a car-call signal.

13. The method according to claim 11, wherein the elevator activity information comprises a hall-call signal.

14. The method according to claim 11, wherein the elevator activity information comprises a hall-call signal and a car-call signal.

15. The method according to claim 11, wherein the elevator activity information comprises statistical load changes in the elevator car based on time-of-day.

16. The method according to claim 11, wherein the elevator activity information comprises hall call request information associated with at least one floor number.

17. The method according to claim 10, wherein the determined characteristic information associated with the cable system comprises the length of the cable system.

18. The method according to claim 10, wherein the determined characteristic information associated with the cable system comprises a cross sectional area.

19. The method according to claim 10, wherein the determined characteristic information associated with the cable system comprises a modulus of elasticity.

20. The method according to claim 10, wherein the determined characteristic information associated with the cable system comprises an integer number associated with a number of cables within the cable system.

21. The method according to claim 10, wherein the adjusted cable system length compensates for a length increase in the cable system due to a load increase.

22. The method according to claim 10, wherein the adjusted cable system length compensates for a length decrease in the cable system due to a load reduction.

23. A method of positioning an elevator car in an elevator system, the elevator system comprising the elevator car suspended in an elevator shaft by an elevator cable system, and an elevator system controller for controlling an elevator motor, wherein the elevator motor transfers motion to the cable system so that the elevator car may move within the elevator shaft, the method comprising the steps of:

(a) transferring data associated with the weight of the elevator car to the elevator system controller;

(b) transferring data associated with the position of the elevator car to the system controller in order to calculate the length of the elevator cable system;

(c) calculating a change in the length of the elevator cable system at the elevator system controller based on the calculated length of the elevator cable system and the data associated with the weight of the elevator car;

(d) generating a control signal at the system controller based on the calculated change in the length of the elevator cable system; and (e) sending the generated control signal to the elevator motor for adjusting the length of the of the elevator cable system in order to compensate for the calculated change in the length of the elevator cable system.

24. The method according to claim 23, wherein the generated control signal is an analog signal.

25. The method according to claim 23, wherein the generated control signal is a digital signal.

26. The method according to claim 23, wherein adjusting the length of the cable system comprises reducing the length of the cable system by an amount substantially the same as the calculated change in the length of the elevator cable system, when a load increase in the elevator car is predicted.

27. The method according to claim 23, wherein adjusting the length of the cable system comprises increasing the length of the cable system by an amount substantially the same as the calculated change in the length of the elevator cable system, when a load decrease in the elevator car is predicted.

28. The method according to claim 23, wherein the data associated with the weight of the elevator car comprises a calculated difference between a measured weight of the elevator car and an inferred weight of the elevator car, wherein the inferred weight is predicted based on elevator activity information.

* * * * *